US006109121A

United States Patent [19]

Brown

[11] Patent Number: 6,109,121

[45] Date of Patent: Aug. 29, 2000

[54] ELECTRIC STARTER FOR KICK START MOTORCYCLES

[76] Inventor: Timothy L. Brown, 1514 Long Bay Rd., Middleburg, Fla. 32068

[21] Appl. No.: 09/187,309

[22] Filed: Nov. 4, 1998

[51] Int. Cl.[7] ..... F02N 1/00

[52] U.S. Cl. ..... 74/7 E; 74/6; 123/179.24; 123/185.6

[58] Field of Search ..... 74/6, 7 R, 7 A, 74/7 B, 7 E; 123/179.1, 179.24, 179.25, 185.6

[56] References Cited

U.S. PATENT DOCUMENTS

| | | | |
|---|---|---|---|
| 3,782,356 | 1/1974 | Hamman | 123/185 C |
| 4,185,606 | 1/1980 | Miyata | 123/182 |
| 4,934,210 | 6/1990 | Suzuki | 74/512 |
| 5,497,739 | 3/1996 | Müller | 123/185.6 |

*Primary Examiner*—David M. Fenstermacher
*Attorney, Agent, or Firm*—Thomas C. Saitta

[57] ABSTRACT

An electric starter for a kick-only motorcycle which can be mounted directly on the motorcycle and connected to the kickshaft of the motorcycle, or can be used as a stand-alone starter connected to the kicker arm, where the starter drives a pinion gear which partially rotates a kicker arc gear to crank the motor.

16 Claims, 4 Drawing Sheets

ELECTRIC STARTER FOR KICK START MOTORCYCLES

BACKGROUND OF THE INVENTION

This invention relates generally to the field of devices used to mechanically start internal combustion engines without manual cranking, generally known as starters, and more particularly to such starters used in connection with motorcycles. Even more particularly, the invention relates to starters which can be retrofitted onto or used with kick-only motorcycles.

Starters for initiating internal combustion engines are well known, and primarily consist of an electrically powered motor which through gearing mechanisms rotates the crankshaft of an engine from rest up to a speed at which the engine will commence to operate on its own. The power for the starter is supplied by the vehicle battery. The starter is designed to produce a high power output or torque over a short period of time without exceeding a specified temperature, so that the static inertia and friction inherent in the engine are quickly overcome. Most vehicles with internal combustion engines, such as automobiles, trucks and motorcycles, are provided with starters so that manual starting is not necessary.

Many vintage motorcycles, however, were not built with starters. To crank the engine, a kick pedal is provided which the rider must forcibly move over a partial rotation path, the kick pedal being connected to the kickshaft which is connected through a clutch and gearing or chain mechanisms to the crankshaft. When the rider forces the kick pedal downward, the crankshaft is rotated and the pistons are moved, which starts the engine. For motorcycles with relatively small motors the force required to crank the engine is not great, but for motorcycles with larger motors, motorcycles with defective or improperly maintained motors, and especially for antique or vintage motorcycles, a significant amount of force is required. In many instances a minimum amount of strength is required which exceeds that of some riders, meaning that as an owner ages or the motorcycle changes hands, the owner may not be able to start it. Of even greater import is the fact that there exists a high likelihood on the vintage and large motor motorcycles that the initial kick to start the engine will not be successful and the motor will recoil—driving the kick pedal back in counter rotation to the kicking motion in a very forceful manner. There have been numerous instances where riders or repair shop personnel have been injured, sometimes to the point of broken legs or ankles, by the recoil of the kick pedal. This is such a serious problem that many repair shops refuse to work on kick-only motorcycles, and others will attempt to start kick-only motorcycles by pushing them up to speed or towing them—both dangerous approaches in themselves. Finally, one additional concern arises in the repair scenario, where if it is the cranking mechanism itself that needs to be repaired, it may be necessary to kick start the motorcycle many times in succession to make adjustments.

It is an object of this invention to provide a starter apparatus for a kick-only motorcycle, where the starter is relatively simple in construction and can be permanently mounted onto the motorcycle in a generally unobtrusive manner without requiring any major readjustment or alteration of the structure of the motorcycle, especially of the bottom end where the serial numbers are imprinted. The ability to mount the starter with a minimum of alteration to the motorcycle is especially important with vintage motorcycles, where the value of the motorcycle is a function of the adherence to original equipment and style. To this end the invention is structured such that an electrically powered and controlled starter and kicker arc gear are mounted within the frame members of the bike and connected to the kickshaft in place of the kicker arm and pedal, such that the motorcycle can be automatically started yet the apparatus minimally affects the appearance and rideability of the motorcycle. It is a further object to provide an alternative construction for the starter apparatus which is a stand-alone device for use in a repair shop where the apparatus can be used to start any type of kick-only motorcycle needing repair.

SUMMARY OF THE INVENTION

The invention is in general an electrically powered starter apparatus for cranking motorcycle internal combustion engines normally started with a rider-actuated kick starter. The invention may be incorporated during initial production of the motorcycle, but is primarily designed to be utilized either as a retrofit or add-on assembly mounted onto a motorcycle having no factory installed electric starter as original equipment, or as a stand-alone apparatus to be maintained in motorcycle repair shops to be used to start kick-only motorcycles. The apparatus comprises an electrically powered starter which advances and rotates a pinion drive gear when the starter is actuated. The pinion gear engages the teeth of a larger kicker arc gear which is connected directly to the kickshaft of the engine in the retrofit version or temporarily connected to the kicker arm in the shop version. The starter and pinion gear rotate the arc gear a sufficient distance to crank the engine, a distance equivalent to that covered by the rider-operated kick starter, with the arc gear driven beyond and disengaged from the pinion gear when that distance has been traversed. The pinion gear then retracts and the crank spring returns the kicker arc gear to the ready position. A meshing spring or other means is provided to advance the kicker arc gear slightly in the passive position in order to mesh the internal gears prior to movement of the arc gear by the starter. The retrofit apparatus is provided with mounting means to secure the apparatus to frame members of the motorcycle and is downsized as much as possible so that the apparatus is unobtrusive when installed. The shop apparatus is provided with a stand and housing, with the stand preferably having means to raise and lower the apparatus.

DETAILED DESCRIPTION OF THE INVENTION

Figure 1:
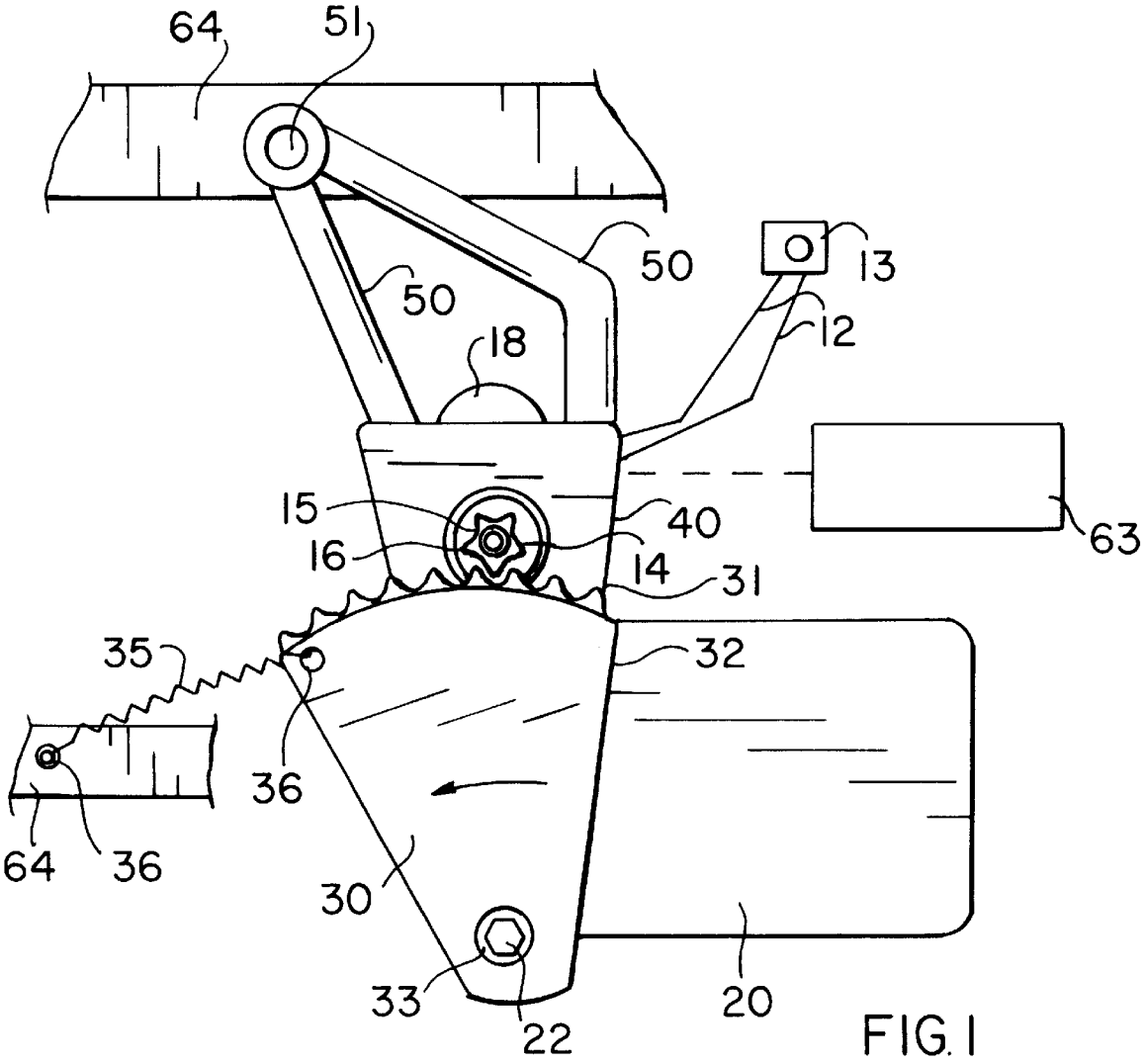
FIG. 1 is a front view of the invention in the passive state as mounted onto a motorcycle.

With reference to the drawings, the invention will now be described in detail with regard for the best mode and the preferred embodiment. The general purpose of the invention is to provide a means for starting or cranking a starter-less or kick-start-only motorcycle engine, which can either be mounted onto the motorcycle or used as a stand-alone piece of equipment in a motorcycle repair shop. The mountable embodiment replaces the kicker arm and kick pedal of the motorcycle, or can be used in conjunction with the kicker arm and kick pedal to allow the user to start the motorcycle either electrically or manually, and is constructed of relatively small overall size so that it can be mounted unobtrusively within the frame members of the motorcycle. The invention comprises in general an electrically powered starter motor 10 which when actuated drives a pinion gear 15 which engages a kicker arc gear 30, with the kicker arc gear 30 connected either permanently to the kickshaft 21 or temporarily to the kicker arm 61 of the motorcycle being started.

Figure 2:
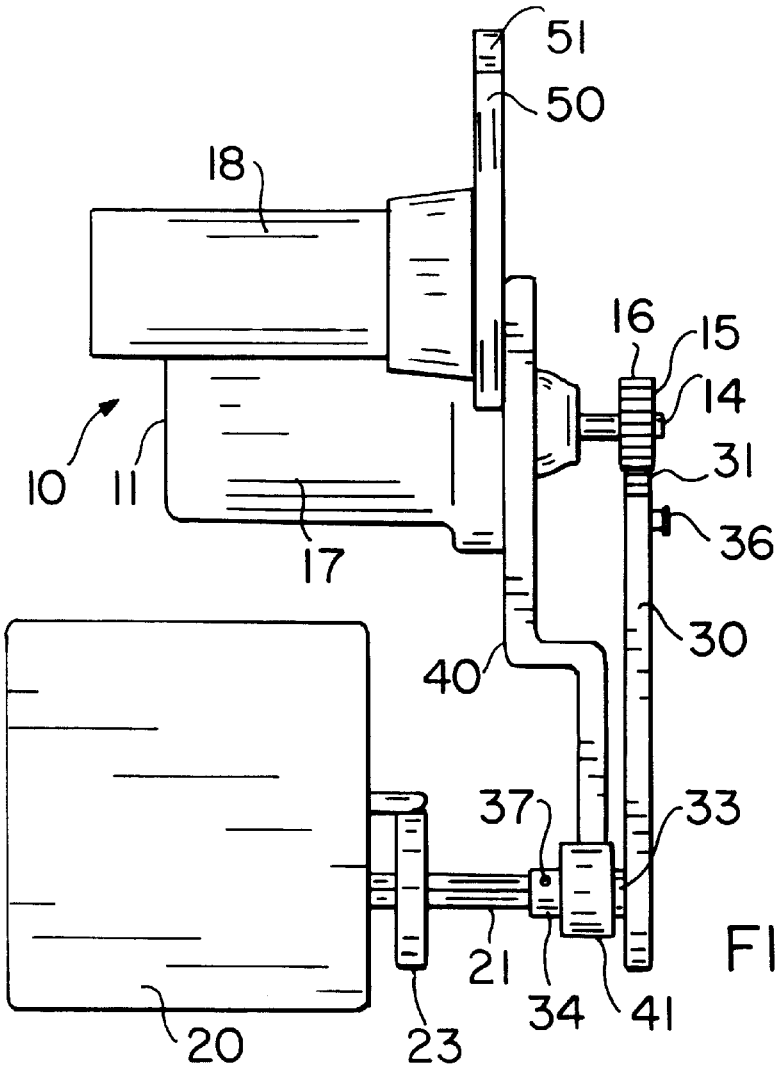
FIG. 2 is an end view of the invention in the passive state.

Referring more directly to FIGS. 1 and 2, the mountable embodiment of the invention is seen to comprise an electrically powered starter 10 within a starter housing 11 affixed by mechanical fasteners, welding or other suitable manner to a mounting plate 40. The starter 10 is powered by electrical wiring connections 12 of standard type connected through a starter switch, button or other type actuator means 13 to the motorcycle battery 63. The starter 10 advances, retracts and rotatingly drives a pinion drive gear 15, circular in configuration with externally mounted teeth 16, which is mounted on the starter shaft 14 and extends from the starter housing 11. Starter 10 may be of any suitable conventional type or style capable of providing sufficient high power output and torque to crank the motorcycle engine, and as shown consists of a common type known as a pre-engaged starter wherein a solenoid 17 is used to first advance the pinion gear 15 outwardly to engage and mesh with the teeth 31 of the kicker arc gear 30, whereupon the electrical motor 18 is activated to rotate the pinion gear 15.

Mounting brackets or brace members 50 are attached to the mounting plate 40 and/or to the starter housing 11, and are used to rigidly connect the invention to the frame members 64 of the motorcycle. The braces 50 may be welded to the frame members 64, may have mechanical clamps or other fastener means for connection to the frame 64, or may include fastener apertures 51 such that the braces 50 can be affixed to shock mounts. The braces 50 may be adjustable in length and angle to allow the device to be mounted on any type frame 64.

Figure 4:
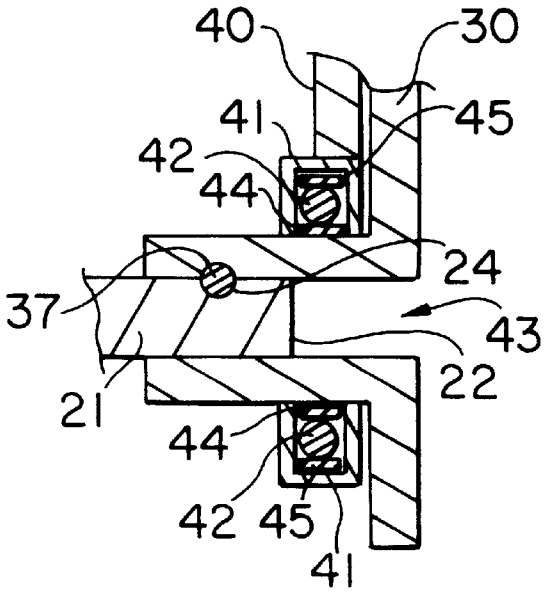
FIG. 4 is a cross-sectional view taken along the axis of the crankshaft showing how the kicker arc gear is mounted onto the crankshaft.

The mounting plate 40 extends below the starter housing 11 and is connected to a bearing housing 41 by welding or mechanical fasteners. Bearing housing 41 is of the type used to support rotating shafts or axles, and comprises an inner race 44 and an outer race 45 which retain a number of roller elements or bearings 42, which are typically round or cylindrical, a feature best shown in FIG. 4. The inner race 44 defines a central bore 43 which receives the arc gear shaft 33, thereby allowing the arc gear shaft 33 to turn freely relative to the bearing housing 41 and the mounting plate 40.

The kicker arc gear 30 is a generally wedge-shaped member equivalent to a portion of a circle, the arc gear 30 having a curved segment of teeth 31 sized to properly intermesh with the teeth 16 of the pinion gear 15. The arc gear 30 is mounted onto a tubular shaft 33 and pivots about the axis of the arc gear shaft 33. The length of the arc encompassing the arc teeth 31 must be sufficient to provide enough contact between pinion teeth 16 and arc teeth 31 when the starter is actuated to rotate the arc gear shaft 33 sufficient distance to crank the motorcycle engine, and is preferably an arc of about 90 degrees which ends in disengagement side 32. The 90 degree arc is greater than necessary to crank the motorcycle engine, but is preferable in that it allows for the fact that the kickshaft 21 may not rebound to its original position after a cranking attempt. In other words, successive starting positions of the arc gear 30 may vary, so an excess of arc teeth 31 insures that some of the teeth 31 of the arc gear 30 will always be in position to mesh with the pinion gear 15. The kicker arc gear 30 is aligned outwardly relative to the pinion gear 15 such that the arc gear 30 and the pinion gear 15 are only engaged when the pinion gear 15 is advanced outwardly by the solenoid 17. When the pinion gear 15 is retracted, as during the rebound after cranking, the arc gear 30 passes the pinion gear 15 without engagement or contact.

The arc gear shaft 33 ends in the kickshaft mount 34, which is sized and configured to fixedly receive in non-rotating manner the end 22 of the motorcycle kickshaft 21 protruding from the crankcase 20. The kickshaft end 22 is typically configured to be either square in cross-section, as shown in the drawings, or the kickshaft end 22 is circular in cross-section with elongated splines or slots, to receive the kicker arm 61 in a non-rotating manner. A locking channel 24 is cut across or into a corner of the kickshaft 21 in a plane perpendicular to its central axis. The kickshaft mount 34 is correspondingly apertured to receive a locking bolt 37, such that once the kickshaft mount 34 is properly positioned onto the end 22 of the kickshaft 21 and the locking bolt 37 inserted, the kickshaft mount 34, arc gear shaft 33 and kicker arc gear 30 cannot be removed from the kickshaft 21 in the axial direction without removing the locking bolt 37. The central axis of the arc gear shaft 33 is coaxially aligned with the central axis of the kickshaft 21. To retrofit a motorcycle having a standard kicker arm 61 and kicker pedal 62, the arm 61 and pedal 62 are simply removed to expose the kickshaft end 22 and the kickshaft mount 34 is connected to the kickshaft 21. In the preferred embodiment, the kickshaft mount 34 is constructed to allow the kicker arm 61 and pedal 62 to be remounted on the outside of the kicker arc gear 30 onto either the kickshaft end 22 or onto the external side of the kickshaft mount 34 or arc gear shaft 33. This restores the original appearance of the motorcycle and also gives the user the option to ignore the electrically powered starter system and manually kick start the motorcycle if desired.

In the passive state, as shown in FIG. 1, the pinion gear 15 is retracted. In order to prevent impact damage to the internal gears within the crankcase 20 when the starter 10 is actuated, the kicker arc gear 30 is biased in the cranking direction by meshing means 35 so that the internal gears are disposed in a contacting manner prior to any sudden force being delivered. As shown in the drawings, meshing means 35 may be a simple spring affixed to the face of the arc gear 30 by a spring mount 36 and to a part of the motorcycle frame members 64, whereby the arc gear 30 is always pulled toward the cranking direction when in the passive state. Alternatively, a hand lever or an automatic mechanism operated by the starter 10 could accomplish this same end.

Figure 3:
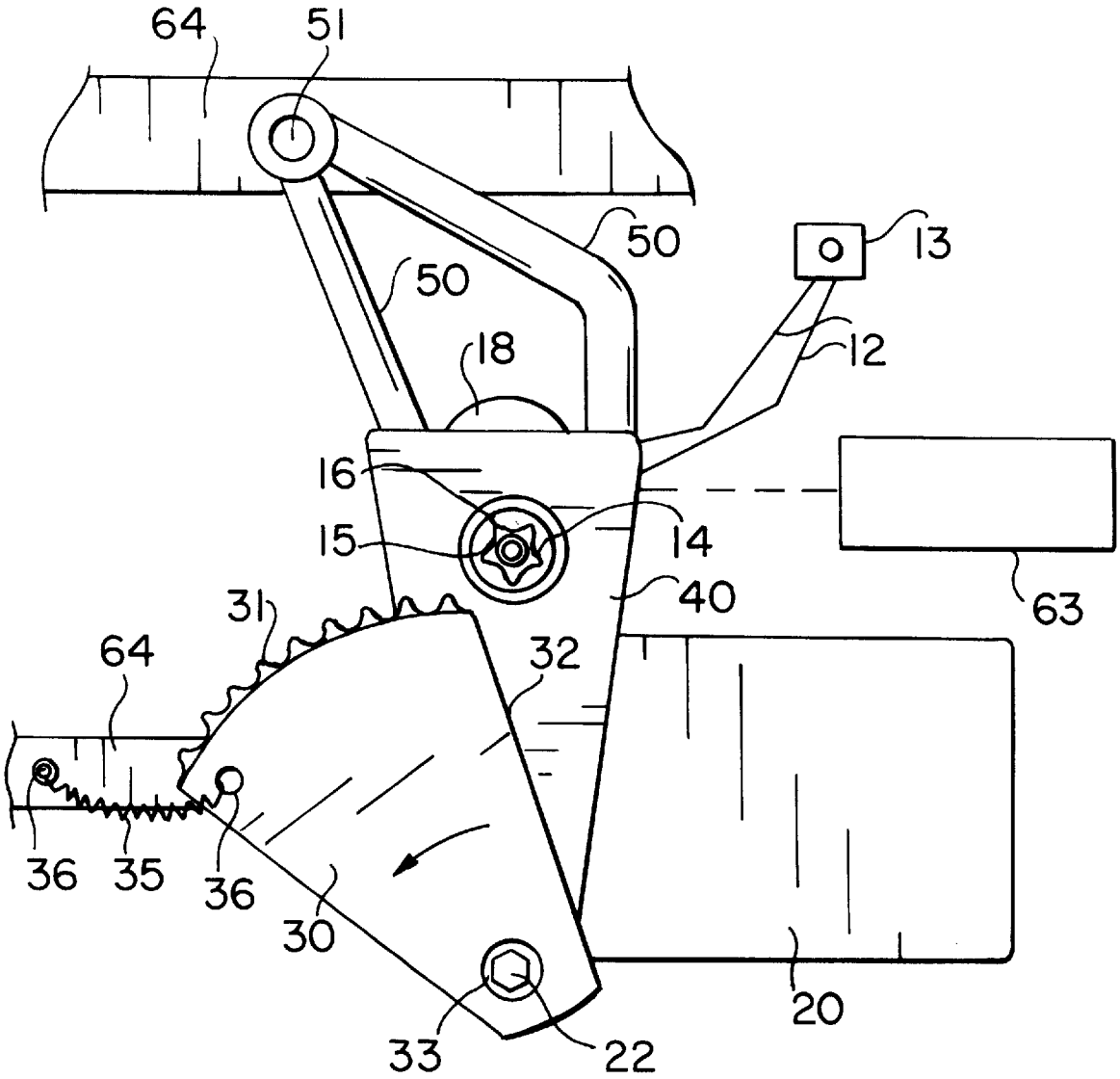
FIG. 3 is a front view of the invention during the cranking operation at the point where the teeth of the kicker arc gear have cleared the pinion gear.

When the starter 10 is actuated, the pinion gear 15 is advanced outwardly so that its teeth 16 engage the teeth 31 of the kicker arc gear 30 in the active state. The starter motor 18 then rotatingly drives the pinion gear 15, which in turn rotates the arc gear 30 in the cranking direction, shown in the drawings as counterclockwise. The arc gear 30 pivots about the central axis of the arc gear shaft 33 and kickshaft 21, thus rotating the kickshaft 21 in the cranking direction. The starter 10 is powered enough time to advance the arc teeth 31 completely beyond the pinion teeth 15, as shown in FIG. 3, with sufficient power being transferred to throw the arc gear 30 a continued distance sufficient to start the motorcycle engine. The pinion gear 15 then retracts and the arc gear 30 is rotated back into the passive position by the motorcycle crank spring 23 mounted on the crankcase 20.

Figure 5:
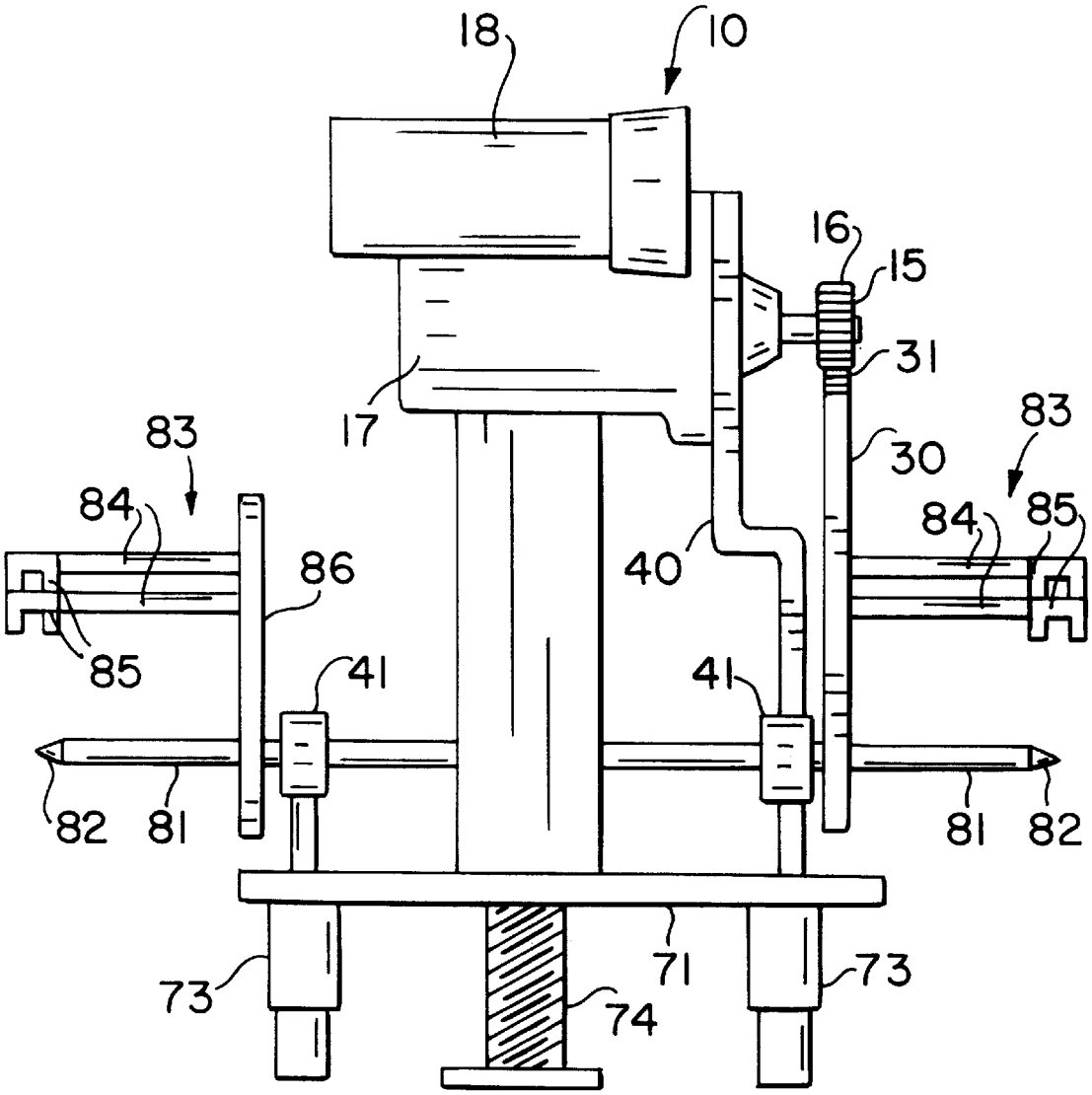
FIG. 5 is an exposed view showing the invention as a stand-alone starter.

A second embodiment of the invention is illustrated in FIG. 5, which is used to start motorcycles in a shop or repair setting. Here the starter 10 and arc gear 30 are mounted on a base member 71, which preferably is enclosed within a housing for safety. The base member 71 is preferably provided with telescoping legs 73 so that the vertical height of the base 71 is adjustable by action of height adjustment means 74 in order to align the apparatus with motorcycles of different height. Height adjustment means 74 may comprise any suitable mechanism operated pneumatically, hydraulically or by manually operated mechanical gearing. In this embodiment the arc gear 30 pivots about a centering shaft 81 which extends outwardly from the arc gear 30 at the pivot axis. Centering shaft 81 has a pointed or tapered end 82 which is used to coaxially align the centering shaft 81 with the kickshaft of the motorcycle, the standard motorcycle kickshaft having an axial indentation for this purpose. Preferably the centering shaft 81 is adjustable in length. Also extending outwardly from the face of the arc gear 30 is kicker attachment means 83 for temporarily connecting the kicker arc gear 30 to the kicker arm of the motorcycle. Kicker attachment means 83 transfers the rotation of the kicker arc gear 30 to the kicker arm of the motorcycle when the starter 10 is actuated, thereby throwing the kicker arm in the cranking direction and starting the motorcycle. Kicker attachment means 83 may comprise any suitable mechanical arrangement for securely gripping the kicker arm, and as shown comprises a pair of arm mounts 84, which are also preferably adjustable in length, with each having a connector mechanism 85, such as a hook, U-shaped clamp or other clamping mechanism which may be locked or tightened for connection directly onto the kicker arm.

In a more preferred embodiment, a second centering shaft 81 and a second set of kicker attachment means 83 mounted on plate 86 extend from the opposite side of the arc gear 30. This enables the device to rotate the kicker arm 61 in either direction, since some motorcycles are cranked in the clockwise direction. It is also possible to replace the battery operated starter 10 with equivalent power means, such as AC powered motors, as well as pneumatically or hydraulically operated motors, which are capable of delivering the required high, relatively instantaneous torque for cranking a motorcycle engine.

It is understood and contemplated that certain equivalents and substitutions for elements set forth above may be obvious to those skilled in the art, and the true scope and definition of the invention therefore is to be as set forth in the following claims.

I claim:

1. A device for cranking an engine on a motorcycle, said motorcycle having a kickshaft which rotates a crankshaft to move pistons within the engine, comprising (A) a battery powered starter capable of delivering high torque through a pinion gear, said starter comprising a pinion gear having teeth for engagement with the teeth of a kicker arc gear, where said pinion gear moves relative to said kicker arc gear such that said teeth of said pinion gear are not engaged with said teeth of said kicker arc gear in a passive state and are engaged with said teeth of said kicker arc gear in an active state;

(B) a kicker arc gear having a curved segment of teeth which engage with said teeth of said pinion gear in said active state, and a kickshaft mount for connecting said kicker arc gear directly to a kickshaft of a motorcycle;

where in said active state said starter rotates said pinion gear, which rotates said kicker arc gear and rotates said kickshaft sufficient distance for cranking a motorcycle engine.

2. The device of claim 1, further comprising a mounting plate connecting said starter to said kicker arc gear, said kicker arc gear having an arc gear shaft and said mounting plate having a bearing housing which receives said arc gear shaft in a rotating manner.

3. The device of claim 2, further comprising mounting brace members for connecting said mounting plate to a motorcycle.

4. The device of claim 1, further comprising meshing means to bias said kicker arc gear in the cranking direction in the passive state.

5. A device for cranking an engine on a motorcycle, said motorcycle having a kicker arm connected to a kickshaft which rotates a crankshaft to move pistons within the engine, comprising (A) a floor-mounted housing;

(B) power means mounted within said housing and capable of delivering high torque through a pinion gear, said power means comprising a pinion gear having teeth for engagement with the teeth of a kicker arc gear, where said pinion gear moves relative to said kicker arc gear such that said teeth of said pinion gear are not engaged with said teeth of said kicker arc gear in a passive state and are engaged with said teeth of said kicker arc gear in an active state;

(C) a kicker arc gear pivotally mounted with said housing and having a curved segment of teeth which engage with said teeth of said pinion gear in said active state, a centering shaft extending from the pivot axis of said kicker arc gear, and kicker attachment means for connecting said kicker arc gear directly to a kicker arm of a motorcycle;

where in said active state said power means rotates said pinion gear, which rotates said kicker arc gear, said kicker attachment means and said kicker arm sufficient distance for cranking a motorcycle engine.

6. The device of claim 5, where said housing further comprises height adjustment means.

7. The device of claim 5, where said kicker attachment means comprises a pair of arm mounts and connector means.

8. The device of claim 7, where said connector means comprise U-shaped bolts.

9. The device of claim 5, further comprising a second centering shaft and second kicker attachment means extending form the opposite side of said arc kicker gear.

10. The device of claim 5, where said power means is powered by a battery.

11. A device for cranking an engine on a motorcycle, said motorcycle having a kickshaft which rotates a crankshaft to move pistons within the engine, comprising (A) an electrically powered starter capable of delivering high torque;

(B) a kickshaft mount for externally connecting said starter to a kickshaft of a motorcycle;

where said starter is adapted to rotate said kickshaft sufficient distance for cranking a motorcycle engine.

12. The device of claim 11, where said starter rotates said kickshaft less than 90 degrees.

13. The device of claim 11, where said starter delivers said torque to said kickshaft through a gearing mechanism.

14. The device of claim 13, further comprising a kicker arc gear connecting said starter to said kickshaft mount, where said starter rotates said kicker arc gear to rotate said kickshaft.

15. The device of claim 11, where said starter is adapted to be mounted onto said motorcycle.

16. The device of claim 11, further comprising a floor-mounted housing.

* * * * *